US009081341B2

(12) United States Patent
Sugaya

(10) Patent No.: US 9,081,341 B2
(45) Date of Patent: Jul. 14, 2015

(54) IMAGE HEATING APPARATUS

(71) Applicant: CANON KABUSHIKI KAISHA, Tokyo (JP)

(72) Inventor: Kenjirou Sugaya, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/949,582

(22) Filed: Jul. 24, 2013

(65) Prior Publication Data

US 2014/0037314 A1 Feb. 6, 2014

(30) Foreign Application Priority Data

Jul. 31, 2012 (JP) ..... 2012-169518

(51) Int. Cl.
*G03G 15/20* (2006.01)

(52) U.S. Cl.
CPC ..... *G03G 15/2053* (2013.01); *G03G 15/2042* (2013.01)

(58) Field of Classification Search
USPC ..... 399/45, 69, 67
See application file for complete search history.

(56) References Cited

U.S. PATENT DOCUMENTS 6,810,230 B2 * 10/2004 Imai et al. ..... 399/328
7,045,749 B2 * 5/2006 Kinouchi et al. ..... 219/619
7,194,234 B2 * 3/2007 Katakabe et al. ..... 399/330
8,055,175 B2 11/2011 Sugaya
8,385,801 B2 2/2013 Sugaya
2010/0296828 A1 * 11/2010 Hara et al. ..... 399/69
2012/0107002 A1 * 5/2012 Nakayama et al. ..... 399/69
2012/0148304 A1 6/2012 Sugaya et al.
2012/0148318 A1 6/2012 Sugaya et al.
2012/0155934 A1 6/2012 Takeuchi et al.
2012/0328338 A1 * 12/2012 Nawa et al. ..... 399/328
2013/0034363 A1 * 2/2013 Hara ..... 399/69
2013/0279931 A1 * 10/2013 Kakehi ..... 399/66
2014/0029994 A1 1/2014 Sugaya
2014/0037308 A1 * 2/2014 Nawa et al. ..... 399/45

FOREIGN PATENT DOCUMENTS

JP 2012-128312 A 7/2012

* cited by examiner

*Primary Examiner* — Clayton E LaBalle
*Assistant Examiner* — Warren K Fenwick
(74) *Attorney, Agent, or Firm* — Fitzpatrick, Cella, Harper & Scinto

(57) ABSTRACT

An image heating apparatus includes: a heating member configured to heat a toner image formed on a sheet by using a toner containing a wax; an exciting coil; a magnetic flux suppressing member configured to suppress a part of magnetic flux actable from the exciting coil onto the heating member; a screw shaft configured to hold the magnetic flux suppressing member and configured to slide the magnetic flux suppressing member along a longitudinal direction of the heating member; and a controller configured to control a rotational movement operation of the screw shaft so that the magnetic flux suppressing member is moved to a position depending on a width of the sheet. The controller is, during non-image heating, capable of executing an operation in a mode in which the screw shaft is rotationally moved so that the magnetic flux suppressing member is reciprocated at least once in a predetermined range.

20 Claims, 10 Drawing Sheets

IMAGE HEATING APPARATUS

FIELD OF THE INVENTION AND RELATED ART

The present invention relates to an image heating apparatus for heating a toner image formed on a sheet. This image heating apparatus is usable in image forming apparatuses such as a copying machine, a printer, a facsimile machine and a multi-function machine having a plurality of functions of these machines, for effecting image formation by using an electrophotographic-type process, an electrostatic-recording-type process, a magnetic-recording-type process, and the like.

In the following description, as the image heating apparatus, a fixing device (apparatus) will be described as an example. A type of device in which heat is generated by Joule heat by generating an eddy current in a fixing member by an exciting coil as a means for heating the fixing member (rotatable heating member) has been conventionally proposed. In this type of device, a heat generating source can be placed very near to a toner, and therefore compared with a conventional type device using a halogen lamp, the above-proposed type of device is characterized in that the time required until the temperature of the fixing member during actuation of the fixing device reaches a fixable temperature can be shortened. Further, the above-proposed type of device is also characterized in that a heat-conduction path from the heat generating source to the toner is short, and therefore heat efficiency is high.

However, in the fixing device as described above, when many small-sized recording papers (sheets) having a small width are continuously subjected to fixing (first heating), a so-called non-sheet-passing portion temperature rise can occur. That is, in a region (sheet passing region) where the fixing member contacts the recording paper, heat is absorbed by the recording paper, and on the other hand, in a region (non-sheet-passing region) where the fixing member does not contact the recording paper, heat is not absorbed by the recording paper, so that a large temperature difference can be generated. That is, during the fixing, the temperature of the fixing member is maintained at a predetermined temperature in the sheet passing region, and therefore there is a fear that the fixing member is excessively increased in temperature in the non-sheet passing region. This phenomenon is the non-sheet-passing portion temperature rise.

When such a non-sheet-passing portion temperature rise is generated, the fixing device thermally deteriorates and therefore countermeasures may preferably be taken.

For that reason, in an apparatus described in Japanese Laid-Open Patent Application (JP-A) 2012-128312, a magnetic flux suppressing member for changing a distribution of heat generation of the fixing member with respect to a longitudinal direction of the fixing member, depending on a width size of the recording paper, is employed. Specifically, such a type that the magnetic flux suppressing member is employed and is held by a screw shaft, and then the screw shaft is rotationally moved, thereby sliding the magnetic flux suppressing member to a desired position.

However, in the case of the type in which the magnetic flux suppressing member is slid by using the screw shaft, a wax volatilized from the toner is adhered to and accumulated on the screw shaft. Thus, when the wax is accumulated at a groove portion of the screw shaft, it becomes difficult to properly slide the magnetic flux suppressing member.

SUMMARY OF THE INVENTION

A principal object of the present invention is to provide an image heating apparatus capable of properly sliding a magnetic flux suppressing member.

According to an aspect of the present invention, there is provided an image heating apparatus comprising: a rotatable heating member configured to heat a toner image formed on a sheet by using a toner containing a wax; an exciting coil configured to cause the rotatable heating member to generate heat by electromagnetic induction heating; a magnetic flux suppressing member configured to suppress a part of magnetic flux actable from the exciting coil onto the rotatable heating member; a rotatable screw shaft configured to hold the magnetic flux suppressing member and configured to slide the magnetic flux suppressing member along a longitudinal direction of the rotatable heating member; and a controller configured to control a rotational movement operation of the screw shaft so that the magnetic flux suppressing member is moved to a position depending on a width size of the sheet, wherein the controller is, during non-image heating, capable of executing an operation in a mode in which the screw shaft is rotationally moved so that the magnetic flux suppressing member is reciprocated at least once in a predetermined range.

According to another aspect of the present invention, there is provided an image heating apparatus comprising: a rotatable heating member configured to heat a toner image formed on a sheet by using a toner containing a wax; an exciting coil configured to cause the rotatable heating member to generate heat by electromagnetic induction heating; a magnetic flux suppressing member configured to suppress a part of magnetic flux actable from the exciting coil onto the rotatable heating member; a rotatable screw shaft configured to hold the magnetic flux suppressing member and configured to slide the magnetic flux suppressing member along a longitudinal direction of the rotatable heating member; and a controller configured to control a rotational movement operation of the screw shaft so that the magnetic flux suppressing member is moved to a position depending on a width size of the sheet, wherein the controller is, during non-image heating, capable of executing an operation in a mode in which the screw shaft is rotationally moved so that the magnetic flux suppressing member is reciprocated at least once in a movable range of the magnetic flux suppressing member during image heating.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described, but although the embodiments are an example of best mode in the present invention, the present invention is not limited to these embodiments.

Embodiment 1

<Image Forming Apparatus>

Figure 2:
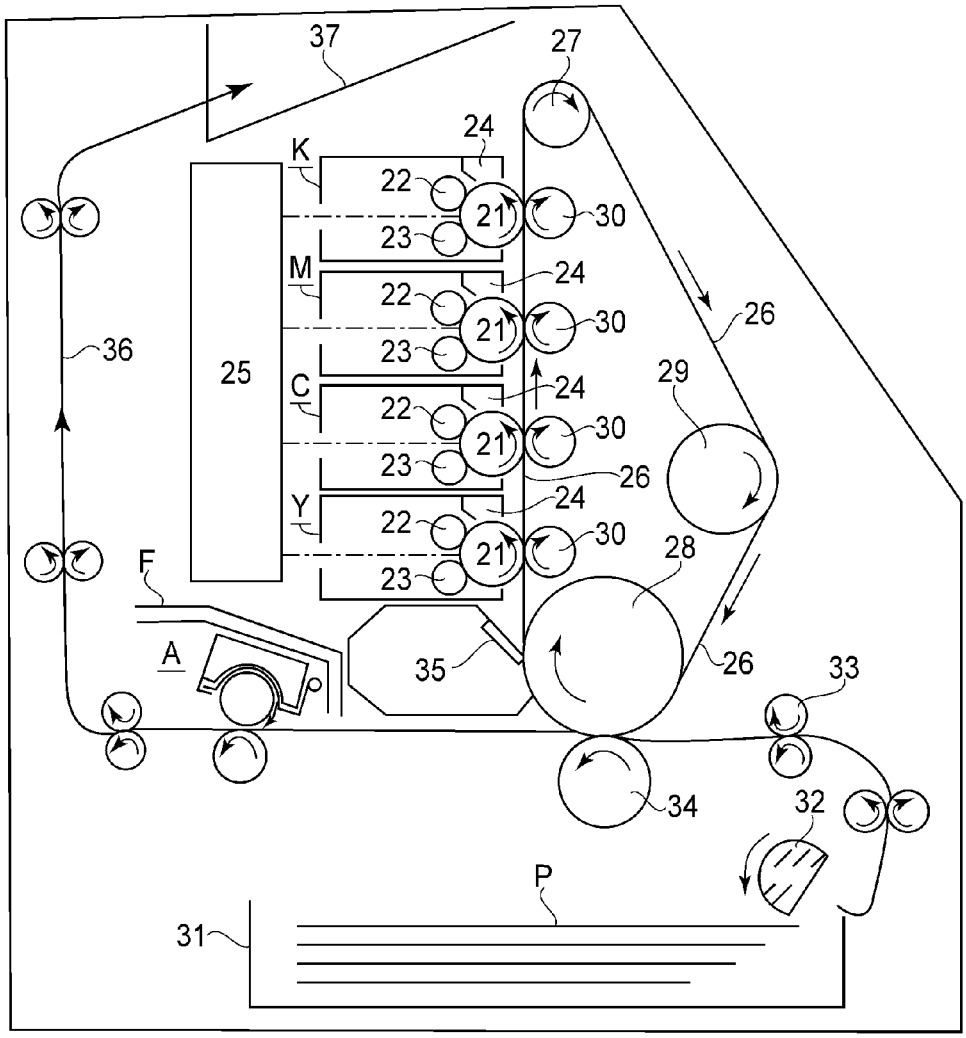
FIG. 2 is a schematic illustration of an example of an image forming apparatus in Embodiment 1.

FIG. 2 is a schematic illustration of an example of an image forming apparatus in which an image heating apparatus, of an electromagnetic induction heating type, according to the present invention is mounted as a fixing device A. This image forming apparatus is a color image forming apparatus using an electrophotographic-type process.

Y, C, M and K represent four image forming portions for forming color toner images of yellow (Y), cyan (C), magenta (M) and black (K), respectively, and are arranged in this order from a lower portion to an upper portion. Each of the image forming portions Y, C, M, and K includes an electrophotographic photosensitive drum 21, a charging device 22, a developing device 23, a cleaning device 24, and the like.

In the developing device 23 of the image forming portions Y, C, M and K, toners of Y, C, M and K are accommodated.

Each drum 21 is rotationally driven in the counterclockwise direction of an arrow at a predetermined peripheral speed. An optical system 25 for forming an electrostatic latent image by subjecting each of the drums 21 to exposure to light is provided correspondingly to the image forming portions Y, C, M and K for the above-described four colors. As the optical system, 25, a laser scanning exposure optical system is used.

At each of the image forming portions, Y, C, M and K, the drum 21 electrically charged uniformly by the charging device 22 is subjected to scanning exposure on the basis of image data by the optical system 25, so that an electrostatic latent image corresponding to a scanning exposure image pattern is formed on the drum surface.

The resultant electrostatic latent images are developed into the toner images by the developing devices 23. That is, a yellow (Y) toner image is formed on the drum 21 for the yellow image forming portion Y and a cyan (C) toner image is formed on the drum 21 for the cyan image forming portion C. Further, a magenta (M) toner image is formed on the drum 21 for the magenta image forming portion M and a black (K) toner image is formed on the drum 21 for the image forming portion K.

The above-described color toner images formed on the drums 21 for the respective image forming portions Y, C, M and K are successively primary-transferred superposedly onto an intermediary transfer member 26, rotated in synchronism with and at the substantially the same speed as rotation of the respective drums 21, in a predetermined alignment state. As a result, unfixed full-color toner images are synthetically formed on the intermediary transfer member 26.

In this embodiment, as the intermediary transfer member 26, an endless intermediary transfer belt is used. The belt 26 is wound and stretched around three rollers consisting of a driving roller 27, a secondary transfer opposite roller 28, and a tension roller 29. Further, the belt 26 is driven by the driving roller 27 in the clockwise direction of an arrow at the substantially same peripheral speed as that of the drum 21 to be circulated and moved.

As a primary transfer means for transferring the toner image from the drum 21 for each of the image forming portions Y, C, M and K onto the belt 26, a primary transfer roller 30 is used. To the primary transfer roller 30, a primary transfer bias of a polarity opposite to that of the toner is applied from an unshown bias power source. As a result, the toner image is primary-transferred from the drum 21 for each of the image forming portions Y, C, M and K onto the belt 26. After the primary-transfer from the drum 21 onto the belt 26 at each of the image forming portions Y, C, M and K, toner remaining on the photosensitive drum 21 as transfer residual toner is removed by the cleaning device 24.

The above-described steps are performed with respect to the respective colors of Y, C, M and K in synchronism with the rotation of the belt 26 to successively form superposedly the primary-transferred toner images for the respective colors on the belt 26. Incidentally, during image formation for only a single color (in a single color mode), the above-described steps are performed for only the single color.

A recording paper (sheet or recording material) P in a recording paper cassette 31 is separated and fed one by one by a feeding roller 32. The fed recording paper P is conveyed, with predetermined timing by registration rollers 33, to a secondary transfer nip which is a press-contact portion between a secondary transfer roller 34 and a belt 26 portion extended and wound around the secondary transfer opposite roller 28.

The primary-transferred synthetic toner images formed on the belt 26 are simultaneously transferred onto the recording paper P by a bias, of a polarity opposite to that of the toner, applied from an unshown bias power source to the secondary transfer roller 34. After the secondary transfer, secondary transfer residual toner remaining on the belt 26 is removed by an intermediary transfer belt cleaning device 35.

The toner images secondary-transferred onto the recording paper P are heat-fixed (fusing and color mixing fixing) on the recording paper P by a fixing device A as the image heating apparatus, so that the recording paper P is sent, as a full-color print, to a sheet discharge tray 37 through a sheet discharge path 36.

<Fixing Device A>

In the following description, with respect to the fixing device A or members constituting the fixing device A, a longitudinal direction or a widthwise direction refers to a direction parallel to a direction perpendicular to a recording paper conveyance direction a (FIG. 5) in a plane of a recording paper conveyance path. Further, a short direction refers to a direction parallel to the recording material conveyance direction a. With respect to the fixing device A, a front surface refers to a surface as seen from a recording paper entrance side with respect to the recording paper conveyance direction, and a rear surface is a surface (a recording paper exit side) opposite from the front surface. The left (side) and the right (side) refer to left (side) and right (side) as seen from the front surface side of the fixing device A. An upstream side and a downstream side refer to an upstream side and a downstream side with respect to the recording paper conveyance direction a. Up and down are up and down with respect to a direction of the gravitation.

Figure 3:
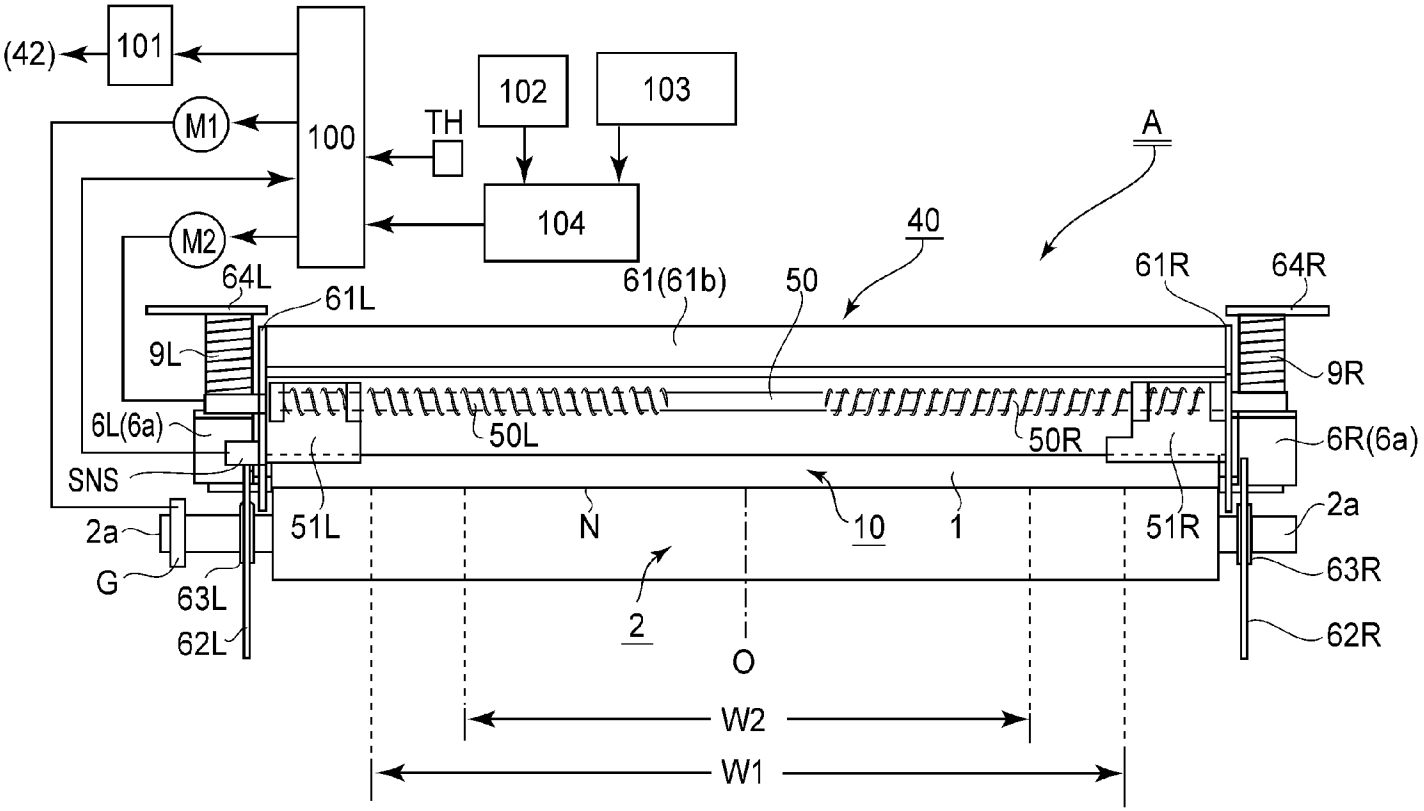
FIG. 3 is a schematic front view of a principal part of the fixing device and is a block diagram of a control system in Embodiment 1.
Figure 4:
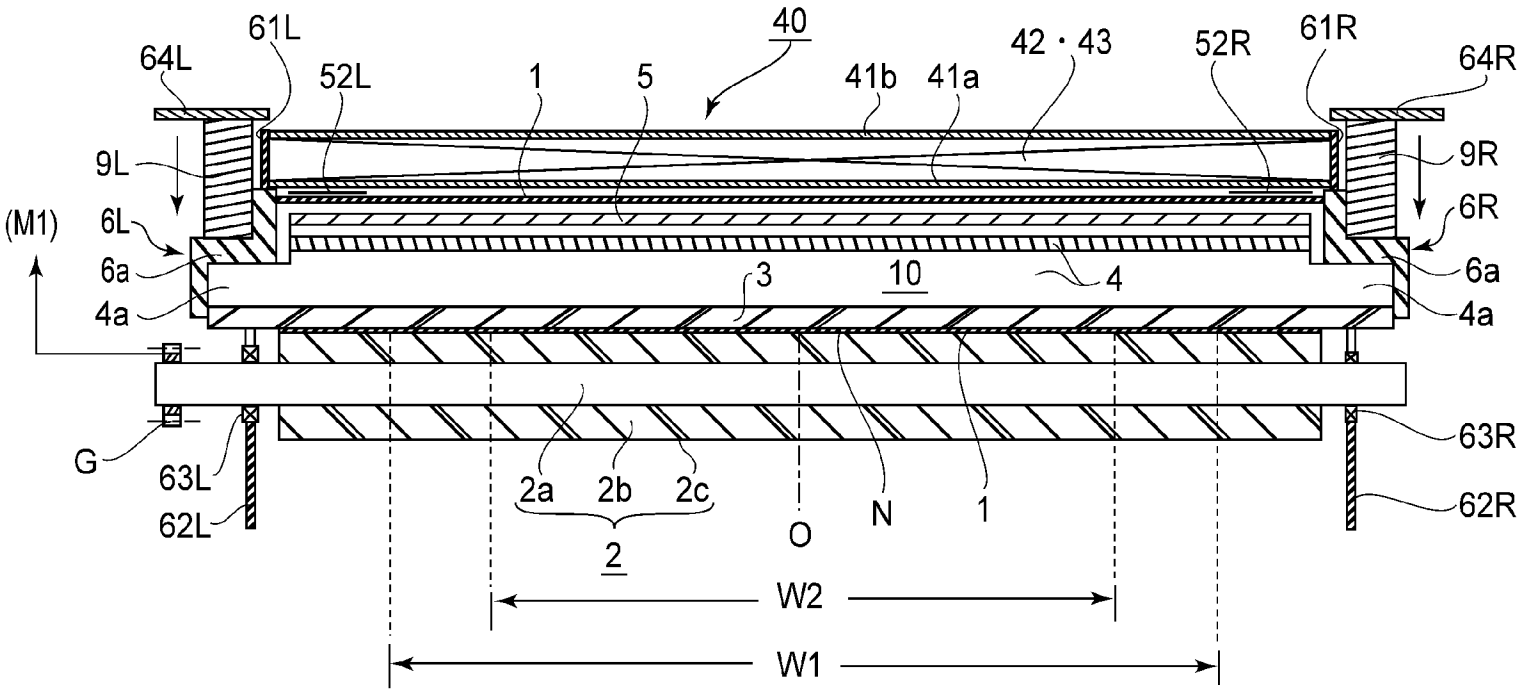
FIG. 4 is a schematic longitudinal front view of the principal part of the fixing device.
Figure 5:
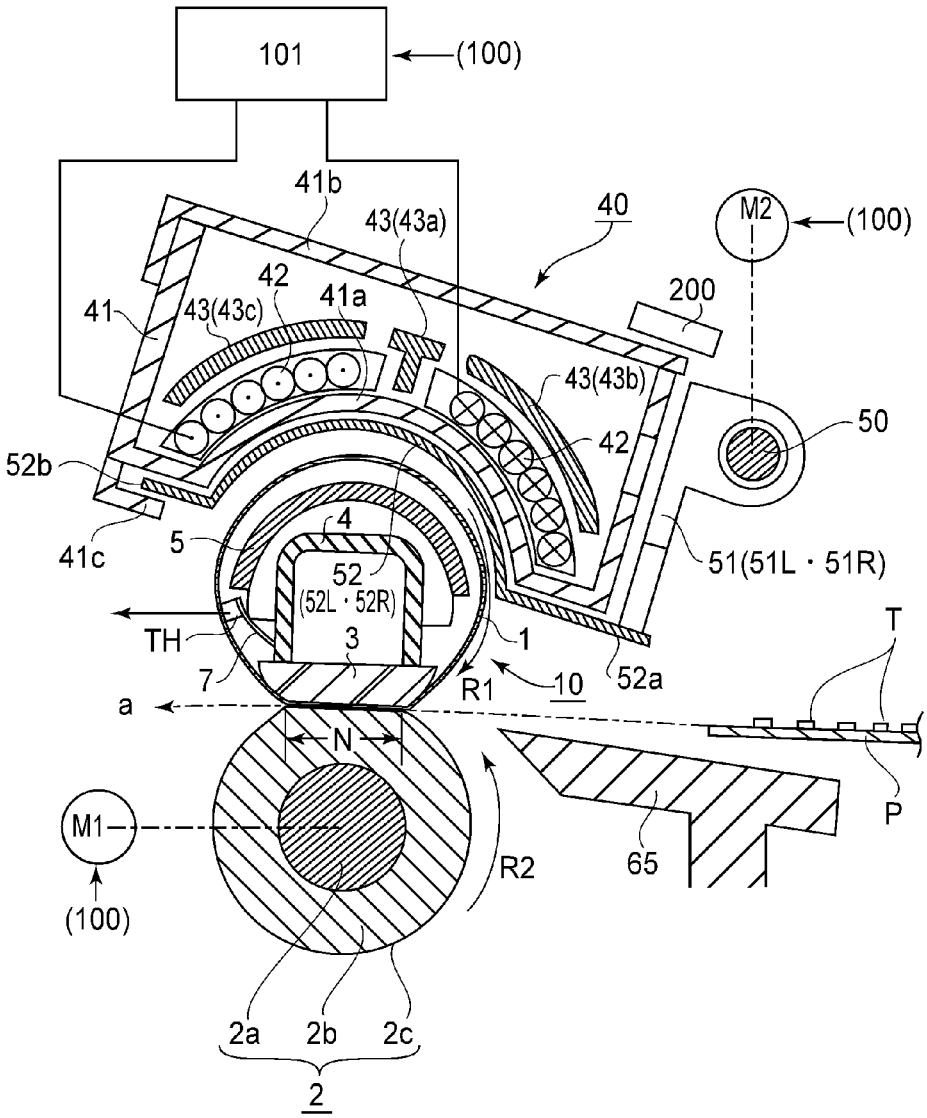
FIG. 5 is an enlarged schematic cross-sectional view of the principal part of the fixing device.
Figure 6:
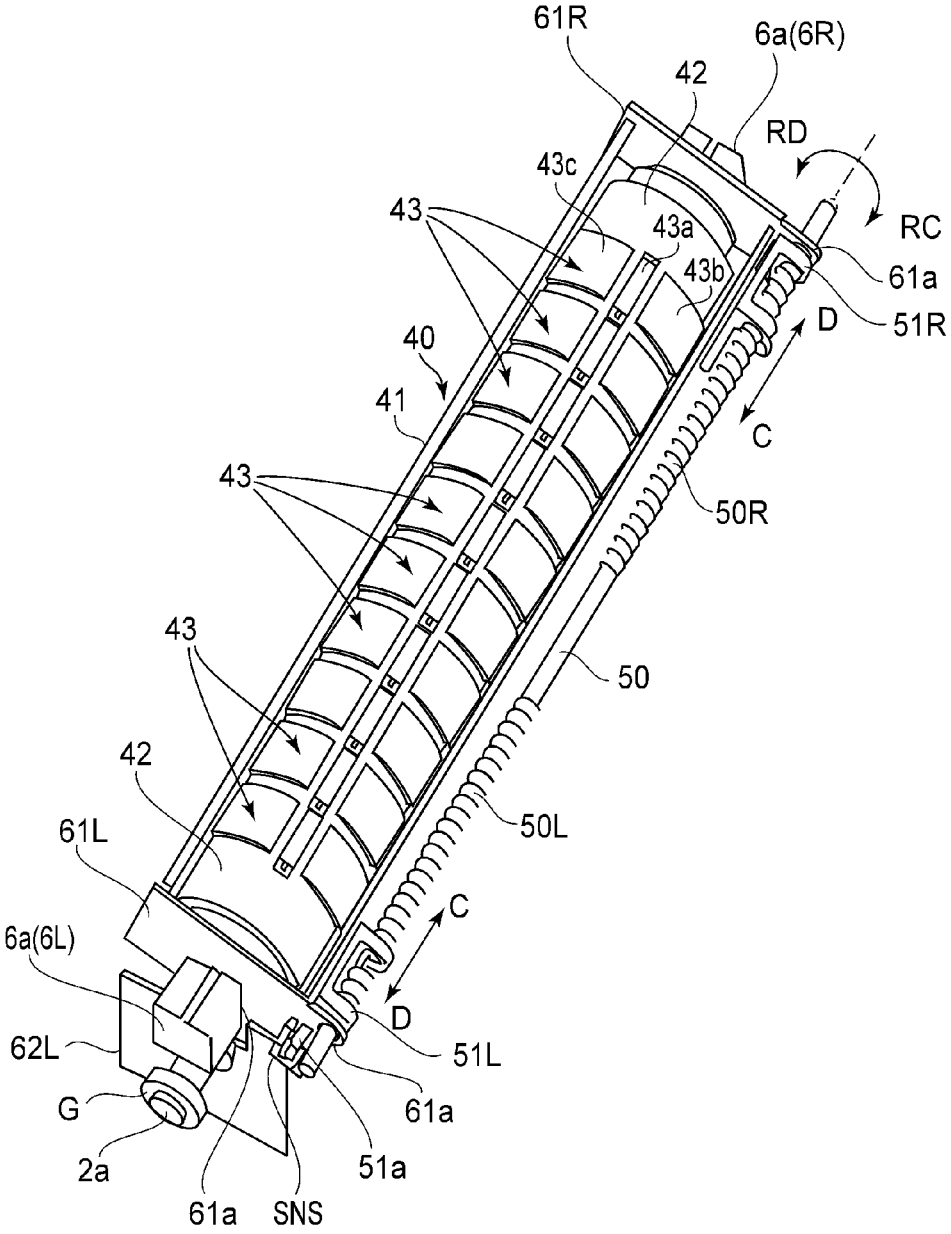
FIG. 6 is a schematic perspective view of the principal part of the fixing device in a state in which an inner portion of a coil unit is shown.

The fixing device A in this embodiment is an image heating apparatus of an external heating type and of an electromagnetic induction heating type. FIG. 3 is a schematic front view of a principal part of the fixing device A and is a block diagram of a control system. FIG. 4 is a schematic longitudinal front view of the principal part of the fixing device A. FIG. 5 is an enlarged schematic cross-sectional view of the principal part of the fixing device A. FIG. 6 is a schematic perspective view of the principal part of the fixing device A in a state in which an inner portion of a coil unit is shown.

This fixing device D roughly includes the following members and means.

a: A heating assembly 10 includes a flexible endless belt (hereinafter referred to as a fixing belt or a belt) 1 as a rotatable heating member (image heating member) contactable to an image carrying surface of the recording paper P.

b: An elastic pressing roller 2 functions as a back-up member (opposing member, pressing member, rotatable pressing member) opposing the belt 1 of the heating assembly 10.

c: A pressing urging member (pressing means) 9 (9L, 9R) forms a fixing nip (nip) N by pass-contacting the belt 1 and the pressing roller 2 with each other.

d: A coil unit (induction heating device) 40 functions as a magnetic flux generating means for heating the belt 1.

e: A magnetic flux suppressing member (magnetic flux shielding member, magnetic flux adjusting member) 52 (52L, 52R) is provided along with a moving mechanism (driving mechanism) M2, 50, 51 (51L, 51R) moving the magnetic flux suppressing member 52.

(1) Heating Assembly 10

The heating assembly 10 includes the rotatable heating member 1 containing a metal layer (magnetic member, electroconductive member) that generates heat by electromagnetic induction when magnetic flux (magnetic field) generated from the coil unit 40 functioning as the magnetic flux generating means described later. In this embodiment, this rotatable heating member 1 is a flexible endless (cylindrical) belt member (endless belt). Further, the rotatable heating member 1 includes a metal-made stay 4 having a downward U-shape in cross section. In a lower side of this stay 4, a pressing pad (nip pad) 3 as a pressure-imparting member is mounted along a longitudinal direction of the stay 4.

The pad 3 is a member for forming the fixing nip N by causing a predetermined pressing (urging) force to act between the belt 1 and the pressing roller 2 and is formed of a heat-resistant resin. The stay 4 is required to have rigidity (stiffness) for applying the pressure to the nip N, and is formed of iron in this embodiment. In an upper side (coil unit 40 side) of the stay 4, an inside magnetic core (magnetic shielding member, magnetic shielding core) 5, having a substantially arcuate shape in cross section, for concentrating the magnetic flux at the belt 1 in order to efficiently induction-heat the belt 1 is provided along the longitudinal direction of the stay 4. This core 5 also prevents a temperature rise due to the induction heating of the metal-made stay 4.

At each of left and right end portions of the stay 4, an extended arm portion 4*a* is provided. The extended arm portions 4*a* project outward from the left and right end portions of the belt 1, respectively. With the left and right arm portions 4*a*, left and right symmetrical flange members 6L and 6R are engaged, respectively. The belt 1 is externally engaged loosely with a composite member of the above-described pad 3, the stay 4 and the core 5. The left and right flange members 6L and 6R are regulating (limiting) members for regulating (limiting) movement of the belt 1 in the longitudinal direction and the shape of the belt 1 with respect to a circumferential direction.

In the belt 1, as described later, as a base layer 1*a* (FIG. 7), a metal layer which generates heat by electromagnetic induction heating is provided. For that reason, as described later, as a means for regulating (limiting) lateral movement of the rotating belt 1 in a widthwise direction, the flange members 6L and 6R only for simply receiving end surfaces of the belt 1 may only be required to be provided, so that the constitution of the fixing device A can be simplified.

At a longitudinal central portion of the stay 4, a temperature sensor TH such as a thermistor as a temperature detecting means (temperature detecting element) for detecting a temperature of the belt 1 is provided via an elastic supporting member 7. The sensor TH is elastically contacted to an inner surface of the belt 1 by a member 7. As a result, even when positional fluctuation such as waving of the rotated belt 1 at a sensor contact surface is caused, the sensor TH follows this positional fluctuation, so that a good contact state is maintained.

The above-described belt assembly 10 is provided by engaging pressure-receiving portions 6*a* of the left and right flange members 6L and 6R, between left and right fixed upper side plates 61L and 61R of a fixing device chassis, with vertical guide slit portions 61*a* formed in the side plates 61L and 61R, respectively. Incidentally, a general structure of the chassis was omitted from the figures. Accordingly, the assembly 10 has a degree of freedom such that the assembly 10 is movable in a vertical (up-down) direction along the slit portions 61*a* between the left and right side plates 61L and 61R.

Figure 7:
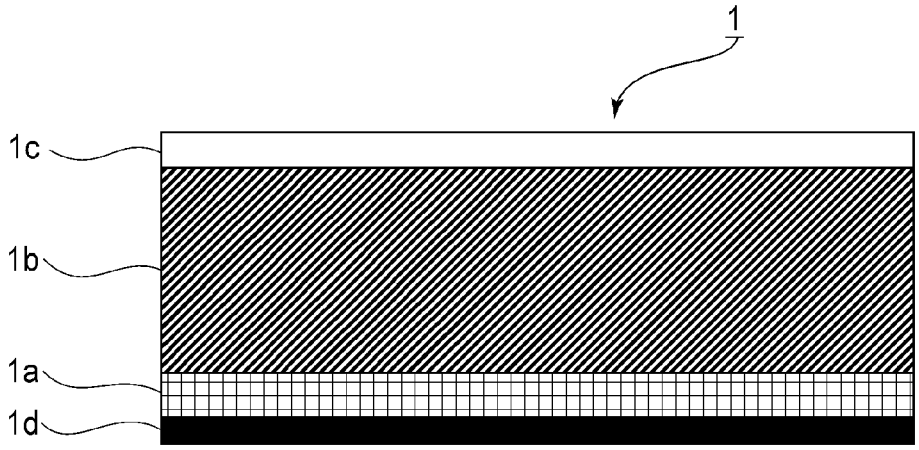
FIG. 7 is a schematic sectional view showing a layer structure of a fixing belt.

FIG. 7 is a schematic view of a layer structure of the belt 1 includes the metal base layer 1*a* of about 20-40 mm in inner diameter. At an outer periphery of the base layer 1*a*, a heat-resistant rubber layer as an elastic layer 1*b* is provided. A thickness of the rubber layer 1*b* may preferably be set in a range of 100-800 μm. In this embodiment, the thickness of the rubber layer 1*b* is set at 1000 μm in consideration of a reduction in warming up time by decreasing the thermal capacity of the belt 1 and obtaining of a fixing image suitable when a color image is fixed. Further, at an outer periphery of the rubber layer 1*b*, as a surface parting layer 1*c*, a layer of a fluorine-containing resin material (e.g., PFA or PTFE) is provided.

In an inner surface side of the base layer 1*a*, in order to lower the sliding friction between the belt inner surface and the temperature sensor TH, a slidable layer 1*d* having a high sliding property may also be provided in a thickness of 10-50 μm. Incidentally, as a material for the metal layer 1*a* of the fixing belt 1, iron alloy, copper, silver, or the like is appropriately selectable.

(2) Pressing Roller 2

The pressing roller 2 is 40 mm in outer diameter, and on a metal core 2*a* formed of metal, a rubber layer as an elastic layer 2*b* is formed, and at a surface thereof, a parting layer 2*c* is provided. The pressing roller 2 is rotatably supported and provided between left and right fixed lower side plates 62L and 62R of the fixing device chassis at left and right end portions of the metal core 2*a* via bearings 63L and 63R. The pressing roller 2 is disposed in parallel to the assembly 10 with respect to the longitudinal direction in a lower side of the heating assembly 10. At a leaf-side end portion of the core metal 2*a*, a pressing roller driving gear G is coaxially and integrally provided.

(3) Pressing Urging Members 9L and 9R

Between the pressure-receiving portions 6*a* of the left and right flange members 6L and 6R of the heating assembly 10 and left and right fixed spring-receiving members 64L and 64R positioned and provided above the flange members 6L and 6R, respectively, left and right stay-pressing (urging) members 9L and 9R as the pressing urging members are compressedly provided.

By predetermined compression reaction forces of the pressing springs 9L and 9R, together with the left and right flange members 6L and 6R of the heating assembly 10, the stay 4 and the pad 3 are equally pressed down in left and right sides. Then, the pad 3 is press-contacted to an upper surface of the pressing roller 2 with a predetermined pressing force against elasticity of the elastic layer 2*b* via the belt 1. By this press contact, between the belt 1 and the pressing roller 2, the fixing nip N having a predetermined width with respect to the recording paper conveyance direction a is formed. The pad 3 assists formation of a pressure profile of the nip portion N.

(4) Coil Unit 40

The coil unit 40 is a heating source (induction heating means) for heating the belt 1 by electromagnetic induction, and is fixed and provided between the left and right fixed upper side plates 61L and 61R of the fixing device chassis in the upper side of the heating assembly 10. With respect to the coil unit 40, inside a housing 41 which is long in a left-right direction and which is an electrically insulating resin molded product as a coil holding member, an exciting coil (coil for generating the magnetic flux) 42 and an outer magnetic core 43 are provided.

A bottom plate 41*a* side of the housing 41 is an opposing surface to the outer surface of the belt 1. The bottom plate 41*a* is curved, in cross section, toward the inside of the housing 41 so as to follow an outer peripheral surface of the belt 1 in a substantially upper-half circumferential range. The housing 41 opposes the upper surface of the belt 1 with a predetermined gap (spacing) in the bottom plate 41*a* side, and is fixed and provided between the upper side plates 61L and 61R.

The coil 42 uses Litz wire as electric wire, and is formed in an elongated (ship's) bottom-like shape and is wound so as to oppose an almost peripheral surface of and a part of a side surface of the belt 1. Further, the coil 42 is abutted against the inner surface of the bottom plate 41*a* curved inside the housing 41, thus being accommodated inside the housing 41. To the coil 42, a high-frequency current of 20-60 kHz is applied from a power source unit (or device) (exciting device) 101 controlled by a controller (control circuit portion: control means) 100.

The external (outside) magnetic core 43 is provided to cover the outside of the coil 42 so that the magnetic flux generated by the coil 42 is prevented from being substantially leaked to a portion other than the metal layer (electroconductive layer) 1*a* of the belt 1. The core 43 is, as shown in FIG. 6, provided along the longitudinal direction of the coil 42 and is divided into a plurality of portions which are arranged in parallel with respect to a direction (longitudinal direction of the coil 42) perpendicular to the recording paper conveyance direction a, and is constituted so as to surround a winding central portion of the coil 42 and its periphery.

Further, in this embodiment, as shown in FIG. 6, a constitution is employed in which each of individual divided cores of the core 43 divided in the plurality of portions with respect to the direction perpendicular to the recording paper conveyance direction a is further divided into 3 portions. That is, the constitution is employed in which the individual divided core is divided into the 3 portions consisting of a central core portion 43*a* corresponding to the winding central portion of the coil 42, and a front-side core portion 43*b* and a rear-side core portion 43*c* in front and rear sides, respectively, the central core portion 43*a*. It is also possible to employ an integral shape of the central core portion 43*a*, the front-side core portion 43*b* and the rear-side core portion 43*c* without dividing the core 43 into the 3 portions.

An upper-side cover plate 61*b* of a housing 61 is provided. FIG. 6 is a schematic perspective view of a principal part of the device A in a state in which the cover plate 61*b* is removed to shown the inside of the coil unit 40 (housing 61).

(5) Magnetic Flux Suppressing Members 52L and 52R and Moving Mechanisms 50 and 51

The magnetic flux suppressing members 52L and 52R are members for suppressing a part of the magnetic flux actable from the coil 42 onto the belt 1 in a region where there is the magnetic flux between the coil 42 and the belt 1. That is, the magnetic flux suppressing member is a means for adjusting the magnetic flux by being moved to an adjusting position (magnetic flux suppressing position) where the magnetic flux is acting in a non-sheet-passing region of the belt 1 when recording paper is passed through the device A having a width narrower than a maximum sheet width of recording paper capable of being passed through the device A, with respect to the widthwise direction (longitudinal direction of the belt 1) perpendicular to the recording paper conveyance direction a.

The magnetic flux suppressing members 52L and 52R are slid by a driving motor M2, a leading screw member (screw shaft) 50 and slidable members 51 (51L and 51R), which are used as the moving mechanism (driving mechanism). Further, an operation of the moving mechanism is controlled by the controller 100. Specifically, depending on width information of the recording paper to be passed through the fixing device A, the sliding of the magnetic flux suppressing member is controlled. These magnetic flux suppressing members 52L and 52R, the moving mechanisms M2, 50 and 51, and movement control will be specifically described below in section (7).

(6) Fixing (Image Heating)

In a stand-by state of the image forming apparatus, in the fixing device A, a fixing motor M1 is turned off and thus rotation of the pressing roller 2 is stopped. Electric energy supply to the coil 42 of the coil unit 40 is turned off.

The controller 100 turns on the fixing motor M1 on the basis of input of a print job start signal (image forming job start signal). As a result, a driving force of the fixing motor M1 is transmitted to the pressing roller driving gear G via a drive transmitting mechanism (not shown), so that the pressing roller 2 is rotationally driven in the counterclockwise direction of an arrow R2 in FIG. 5 at a predetermined speed.

By the rotation of the pressing roller 2, a rotational force acts on the belt 1 by a frictional force between the surface of the pressing roller 2 and the surface of the belt 1 at the fixing nip N. The belt 1 is rotated by the rotation of the pressing roller 2 in the clockwise direction of an arrow R1 at the same speed as the rotational speed of the pressing roller 2 around the stay 4, the pad 3 and the core 5 while sliding on the pad 3 in a state in which its inner surface closely contacts the lower surface of the pad 3. Movement of the belt 1 in a thrust direction of the belt 1 with the rotation of the belt 1 is regulated (limited) by flange portions of the left and right flange members 6L and 6R.

The belt 1 is rotated as described above by the rotational drive of the pressing roller 2 through the driving motor M1 controlled by the controller 100 at least during the fixing (during execution of the image formation). This rotation is performed at a peripheral speed substantially equal to a conveyance speed of the recording paper P carrying an unfixed toner image T conveyed from the image forming portion side. In this embodiment, a surface rotational speed of the fixing belt 1 is 200 mm/sec and it is possible to fix the full-color image on 50 sheets per minute for A4 size and on 32 sheets per minute for A4R size.

The controller 100 supplies an AC current (high-frequency current) of, e.g., 20 kHz to 60 kHz from the power source unit 101 to the coil 42. The coil 42 generates AC magnetic flux (magnetic field) by the supply of the AC current. The AC current is induced by the core 43 into the metal layer 1*a* of the belt 1 in the upper side of the rotating belt 1. Then, an eddy current is generated in the metal layer 1*a*, and by Joule heat due to the eddy current, the metal layer causes self-heat generation (electromagnetic induction heat generation), so that the belt 1 is increased in temperature.

That is, when the rotating belt 1 passes through a region where there is the magnetic flux generated from the unit 40, the metal layer 1*a* generates the heat by electromagnetic induction, so that the belt 1 is heated through its full circumference to be increased in temperature. In this embodiment, the belt 1 and the coil 42 of the unit 40 are maintained in an electrically insulated state by a mold (housing bottom plate) 61*a* of about 2 mm in thickness, so that the belt 1 and the coil 42 are disposed with a certain distance, and the belt 1 is uniformly heated.

A temperature of the belt 1 is detected by the temperature sensor TH. The sensor TH detects the temperature of the belt 1 at a portion corresponding to a sheet passing region, and detected temperature information is fed back to the controller 100. A temperature control functional portion of the controller 100 controls electric power (energy) to be supplied from the power source unit 101 to the coil 42 so that a detected temperature (information on the detected temperature) inputted from the sensor TH is maintained at a predetermined target temperature (fixing temperature: information on a predetermined temperature).

That is, in the case where the detected temperature of the belt 1 is increased to the predetermined temperature, electric energy supply to the coil 42 is interrupted. In this embodiment, temperature adjustment is effected by changing a frequency of the high-frequency current on the basis of a detected value of the sensor TH so that the temperature is kept at a constant temperature of 180° C. which is the target temperature of the belt 1, thus controlling the electric power to be inputted into the coil 42.

In a state in which the roller 2 is driven as described above and the belt 1 is increased in temperature up to the predetermined fixing temperature and is temperature-controlled at the predetermined fixing temperature, the recording paper P carrying thereon the unfixed toner image T is guided and introduced by a guide member 65 into the nip N with its toner image carrying surface toward the fixing belt 1. Then, the recording paper P is intimately contacted to the outer peripheral surface of the belt 1 in the nip N and is nip-conveyed together with the belt 1 through the nip N.

As a result, the heat of the belt 1 is principally provided to the recording paper P and the pressure of the nip N is applied to the recording paper P, so that the unfixed toner image T is heat-fixed on the surface of the recording paper P. The recording paper P passing through the nip N is self-separated (curvature-separated) from the outer peripheral surface of the belt 1, thus being conveyed to the outside of the fixing device A.

The coil unit 40 including the coil 42 is not disposed inside the belt 1 to be heated to the high temperature but is disposed outside the belt 1, and therefore it is hard for the temperature of the coil 42 to become a high, so that the electric resistance is also not increased, and thus it is possible to alleviate loss due to the Joule heat generation even when the high-frequency current is passed through the coil 42. Further, the coil 42 disposed outside the belt 1 also contributes to a small diameter (low thermal capacity) of the belt 1, so that it can be said that the coil 42 consequently has an excellent energy saving property.

In the fixing device A in this embodiment, as shown in FIG. 5, in a cross section, the coil unit 40 is provided by being inclined toward an entrance of the fixing nip N with respect to the heating assembly 10. As a result, an induction-heated portion of the belt 1 by the coil unit 40 is caused to approach the fixing nip N as close as possible with respect to the rotational direction of the belt 1, so that heat efficiency is improved.

(7) Suppression of Non-Sheet-Passing Portion Temperature Rise

As already described above, when sheets of the small-sized recording paper (narrower in width than the maximum width of the recording material usable in the device) are continuously passed through the fixing device A and subjected to fixing in a large amount (when the plurality of sheets of the small-sized recording paper are continuously subjected to image heating), a so-called non-sheet-passing portion temperature rise can be generated. A means for controlling a distribution of heat generation of the fixing device A with respect to the longitudinal direction is controlled depending on the recording paper width size in order to address the non-sheet-passing portion temperature rise will be described.

The sheet passing (conveyance) of the recording paper P through the fixing device A is made on a so-called center (line) basis so that a widthwise center of the recording paper coincides with a widthwise (longitudinal) center of the belt 1. In FIGS. 3 and 4, a line O represents a center reference line (phantom line). A width W1 represents the maximum width of the recording paper usable in the device A, and a width W2 represents a minimum width of the recording paper usable in device A.

In the coil unit 40, a maximum width of the whole of the outside magnetic core 43, which influences the heat generation width of the belt 1 and which is divided into a plurality of portions and disposed with respect to a longitudinal direction, is W1 so as to correspond to the maximum size width W1 of the recording paper P.

Further, in this embodiment, as the magnetic flux adjusting means for adjusting to the various width sizes of recording papers (the maximum size width W1 to the minimum size width W2), the magnetic flux suppressing members 52 (52L and 52R) are used. The magnetic flux suppressing member 52 may also be non-magnetic metal such as aluminum, copper, silver, gold or brass or its alloy or may also be a high-permeability material such as ferrite or permalloy.

The magnetic flux suppressing member 52 is a member for reducing, in a region where there is the magnetic flux between the coil 42 of the coil unit 40 and the belt 1, a part of the magnetic flux actable from the coil 42 toward the belt 1. That is, with respect to the widthwise direction perpendicular to the recording paper conveyance direction a, the magnetic flux suppressing member 52 is a magnetic flux adjusting means for adjusting the magnetic flux by being moved to an adjusting position (magnetic flux suppressing position), where the magnetic flux acting in the non-sheet-passing region of the belt 1 is to be decreased, when the recording paper is passed having a width smaller than the maximum size width of the recording paper capable of being passed.

In the device A in this embodiment, the sheet passing of the recording paper P is made on the center (line) basis, and therefore the pair of magnetic flux suppressing members 52, i.e., 52L and 52R, is disposed in left and right sides of the device A, respectively. With respect to an arrangement position of the magnetic flux suppressing members 52, it would be considered that the magnetic flux suppressing member 52 is disposed between the coil 42 and the outside magnetic core 43, between the coil 42 and the belt 1 or between the belt 1 and the inside magnetic core 5. In this embodiment, a copper plate is used as the magnetic flux suppressing member 52 and is inserted between the coil 42 and the belt 1.

Figure 8:
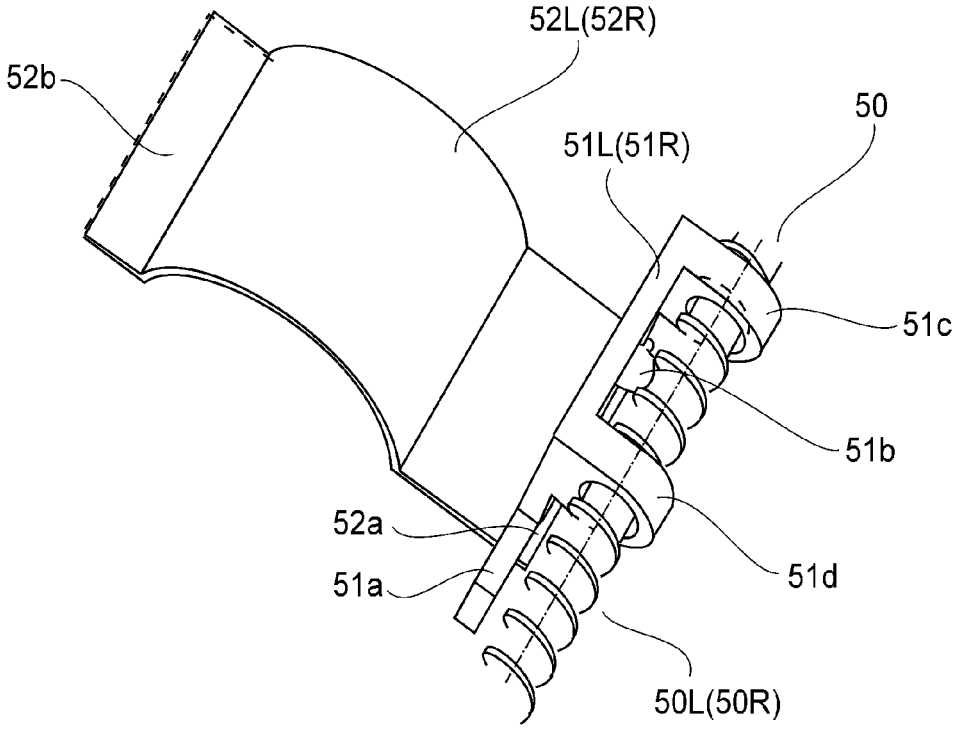
FIG. 8 is a detailed view of a movable portion of the magnetic flux suppressing member.

That is, in the device A in this embodiment, the pair of magnetic flux suppressing members 52 (52L and 52R) is disposed in the left and right sides of the belt 1 in a gap formed between the coil unit 40 and the belt 1. As shown in FIGS. 5 and 8, each of the magnetic flux suppressing members 52L and 52R is a member processed by bonding a band plate-like copper plate in a substantially arcuate shape so as to follow a substantially half-circumferential range of the outer peripheral surface of the belt 1. By the insertion of the magnetic flux suppressing members 52L and 52R, there is an effect of weakening passing of the magnetic flux, formed by the coil 42 and the outside magnetic core 43, through the heat generating layer 1*a* of the belt 1.

The left and right magnetic flux suppressing members 52L and 52R are subjected to positional movement control with respect to the longitudinal direction (left-right direction) of the device A by the moving means. That is, the magnetic flux suppressing members 52L and 52R are movement-controlled between an initial position (retracted position or home position) and the adjusting position (effective position). The initial position is a position that is not located in the region where there is the magnetic flux. The adjusting position is a position for permitting a lowering of temperature in the non-sheet-passing portion region of the belt 1 when the small-sized recording paper is passed having the width smaller than the maximum width of a large-size recording paper capable of being passed through the device A.

By moving the magnetic flux suppressing members 52L and 52R in the longitudinal direction of the device A, a distribution of longitudinal heat generation depending on the width size of the recording paper P to be passed through the device A is controlled.

A longitudinal width 52W (FIG. 1: width with respect to the direction crossing the recording paper conveyance direction) of each of the left and right magnetic flux suppressing members 52L and 52R is not more than a width in which the magnetic flux suppressing member 52L (52R) is able to be disposed at a differential position located between the left (right) fixed upper side plate 61L (61R) of the fixing device chassis and an inner diameter portion longitudinal end of the coil 42. This is based on three reasons: a sufficient width is provided in which a magnetic flux shielding effect is achieved; the maximum heat generation width W1 corresponding to the maximum size width of the recording paper is not decreased; and the magnetic flux suppressing member 52 can be disposed without enlarging the longitudinal width of the fixing device A.

In order to sufficiently achieve the magnetic flux shielding effect, with respect to the width in the direction crossing the recording paper conveyance direction a, a relationship between a longitudinal width 52W of the magnetic flux suppressing members 52L and 52R and a longitudinal width 43W of the outside magnetic core 43, which is divided, is 52W>43W. There is because when this condition is not satisfied, i.e., when the width 52W is smaller than the width 43W, a reducing effect of a degree of the recording paper end portion temperature rise becomes small, and therefore the width 52W is set (defined) so as to be larger than the width 43W of the outside magnetic core 43, which is divided.

Figure 1:
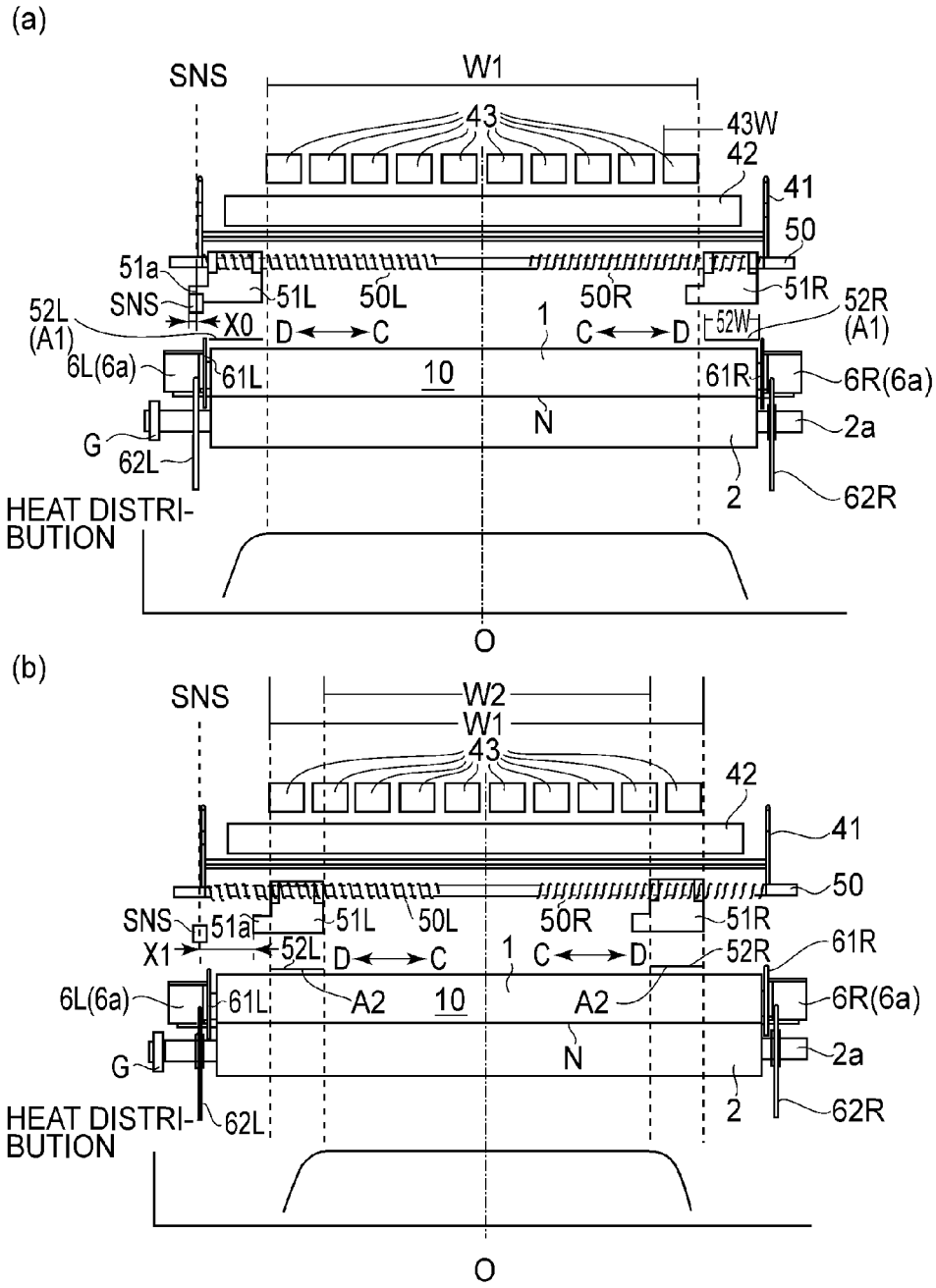
FIGS. 1(*a*) and 1(*b*) are exploded views of constituent members of a fixing device (image heating apparatus) in Embodiment 1, wherein FIG. 1(*a*) shows a state in which each of left and right magnetic flux suppressing members is located in an initial position, and FIG. 1(*b*) shows a state in which each of the left and right magnetic flux suppressing members is moved to an adjusting position corresponding to a position of a minimum size width recording paper during sheet passing.

FIGS. 1(*a*) and 1(*b*) are exploded views of constituent members of the fixing device A, wherein FIG. 1(*a*) shows a state in which each of the left and right magnetic flux suppressing members 52L and 52R is located at an initial position A1, and FIG. 1(*b*) shows a state in which each of the left and right magnetic flux suppressing members 52L and 52R is moved to an adjusting position A2 corresponding to a position during sheet passing of recording paper having the minimum size width W2.

Each of the left and right magnetic flux suppressing members 52L and 52R is, as shown in FIG. 1(*a*), disposed outside the region of the maximum size width W1 of the recording paper to ensure the heat generation distribution corresponding to the maximum size width W1. This position is the initial position A1. The initial position A1 of each of the magnetic flux suppressing members 52L and 52R is deviated from the region in which there is effective magnetic flux between the coil 42 and the belt 1.

During sheet passing of the recording paper having the minimum size width W2, the left and right magnetic flux suppressing members 52L and 52R are moved in an arrow direction C from the initial position (retracted) A1 shown in FIG. 1(*a*) to the adjusting position (magnetic flux suppressing position) A2 shown in FIG. 1(*b*). In FIG. 1(*b*), the magnetic flux suppressing members 52L and 52R are inserted into end portions outside the heat generation width W1 formed by the magnetic flux shielding outside magnetic core 43 which is divided, whereby the magnetic flux passed through the belt 1 is weakened and thus the heat generation distribution corresponding to the minimum size width W2 of the recording paper is formed.

Next, the moving mechanism for the magnetic flux suppressing members 52L and 52R will be described. As shown in FIG. 5, the magnetic flux suppressing members 52L and 52R are disposed between the belt 1 and the coil 42 and are held, in a base portion side 52*a*, by slidable members (holders) 51L and 51R movable in the longitudinal direction of the device A. The magnetic flux suppressing members 52L and 52R are held by the slidable members 51L and 51R so that the magnetic flux suppressing members 52L and 52R to be moved in the longitudinal direction of the device A and the rotating belt 1 do not contact each other.

In this embodiment, by providing the housing 41 of the coil unit 40 with a stopper member 41*c* (FIG. 5) for receiving a free end portion 52*b* of each of the magnetic flux suppressing members 52L and 52R, the magnetic flux suppressing members 52L and 52R are prevented from contacting the belt 1.

As a holding method of the magnetic flux suppressing members 52L and 52R, a constitution is employed in which the slidable members 51L and 51R and the magnetic flux suppressing members 52L and 52R are integral with each other and a constitution may also be employed in which the magnetic flux suppressing members 52 are contacted to the housing 41 in order to ensure a clearance from the belt 1. As a holding method of the slidable members 51 and the magnetic flux suppressing members 52, another method may appropriately be selected. The slidable members 51L and 51R which hold the magnetic flux suppressing members 52L and 52R are disposed symmetrically at longitudinal end portions of the device A with respect to a center reference line O of the sheet passing of the recording paper P.

Between the left and right fixed upper side plates 61L and 61R of the fixing device chassis, in a front side of the coil unit 40, a leading screw member 50 is arranged in parallel to the housing 41 and is disposed while being rotatably supported by bearings 61*a* of the plates 61L and 61R (FIGS. 3 and 6). This leading screw member 50 includes a screw portion 50L in a left-half side and a screw portion 50R in a right-half side, which are screws whose helical directions are opposite to each other. The bearings 61*a* may also be durable bearing members provided separately.

The left and right slidable members 51L and 51R are threadably mounted on the left-side screw portion 50L and the right-side screw portion 50R, respectively, of the leading screw member (screw shaft) 50. The left and right slidable members 51L and 51R, which hold the left and right magnetic flux suppressing members 52L and 52R, are supplied with a driving force from the leading screw member 50 to be slid in a line-symmetrical manner with respect to the center reference line O of the sheet passing of the recording paper P.

The leading screw member 50 is rotationally driven in a normal rotational direction RC shown in FIG. 6, so that the left and right slidable members 51L and 51R are moved in an arrow C direction. On the other hand, the leading screw member 50 is rotationally driven in a reverse rotation direction RD, so that the left and right slidable members 51L and 51R are moved in an arrow D direction.

As shown in FIG. 8, each of the left and right screw portions 50L and 50R of the leading screw member 50 is externally engaged with a cylindrical portions 51*c* and 51*d* of the left and right slidable member 51L or 51R, so that a boss portion 51*b* is engaged with the screw portion 50L or 50R. Here, the cylindrical portions 51*c* and 51*d* externally engaged with the screw portion 50L or 50R may also have a shape such that they contact the screw portion 50L or 50R at three or more points so as to reduce a contact portion area with the screw portion 50L or 50R.

The leading screw member 50 is subjected to rotational drive control in the normal rotational direction RC or the reverse rotational direction RD by transmitting, thereto via a driving gear train, a normal rotational force or a reverse rotational force of a driving motor (e.g., stepping motor) M2 controlled by the controller 100.

In a state in which the left and right magnetic flux suppressing members 52L and 52R are located at the initial position A1 of (a) of FIG. 1, when the leading screw member 50 is normally rotated and driven, each of the left and right magnetic flux suppressing members 52L and 52R is moved toward a longitudinal central portion of the belt 1 with the same movement amount. That is, a spacing between the left and right magnetic flux suppressing members 52L and 52R is narrowed on the center reference line basis.

By controlling the normal rotational amount of the leading screw member 50, the left and right magnetic flux suppressing members 52L and 52R are moved to the adjusting positions A2 for permitting lowering of the temperature at the non-sheet-passing portions when the small-sized recording paper having a width smaller than the maximum width W1 of the large-sized recording paper passes through the apparatus. Each of the adjusting positions A2 is a different position corresponding to each of various widths of the small-sized recording papers.

Further, in a state in which the spacing between the left and right magnetic flux suppressing members 52L and 52R is narrowed, when the leading screw member 50 is reversely rotated and driven, the left and right magnetic flux suppressing members 52L and 52R are moved toward the initial positions A1 in the left and right end portion sides of the belt 1 with the same movement amount. That is, the spacing between the magnetic flux suppressing members 52L and 52R is broadened.

The above-described motor M2, the leading screw member 50, and the slidable members 51L and 51R constitute the moving mechanism for causing the left and right magnetic flux suppressing members 52L and 52R to perform a reciprocation movement operation between the initial position A1 and the adjusting position A2.

Next, control of an operation of the magnetic flux suppressing members 52L and 52R with respect to various paper sizes (W1 to W2) will be described.

As shown in FIGS. 1 and 3, as a means for controlling of the operation of the magnetic flux suppressing members 52 (52L and 52R), the driving motor M2 for driving the leading screw member 50 is provided, a sensor SNS for detecting a position of the magnetic flux suppressing members 52, and the controller 100 for controlling an operation of the driving motor M2 on the basis of a signal of the sensor SNS are provided.

The sensor SNS is a photo-interruptor and effects turning ON and OFF of light blocking by a flag portion 51*a* provided on the left-side slidable member 51L. In view of the generation of a variation in driving, such as backlash, to be transmitted from the driving motor M2 to the leading screw member 50, an edge of the flag portion 51*a* is detected by the sensor SNS, and then positional control of the magnetic flux suppressing member 52 is effected.

The controller 100 reads a signal of an operating portion 102 (FIG. 3) provided on the image forming apparatus and a signal (information on a size width of the recording paper to be passed through the device A) of a recording paper size inputting means 104 of an external host device 103 such as a computer. Then, on the basis of the signals and the signal of the sensor SNS, the controller 100 controls the driving motor M2.

Figure 9:
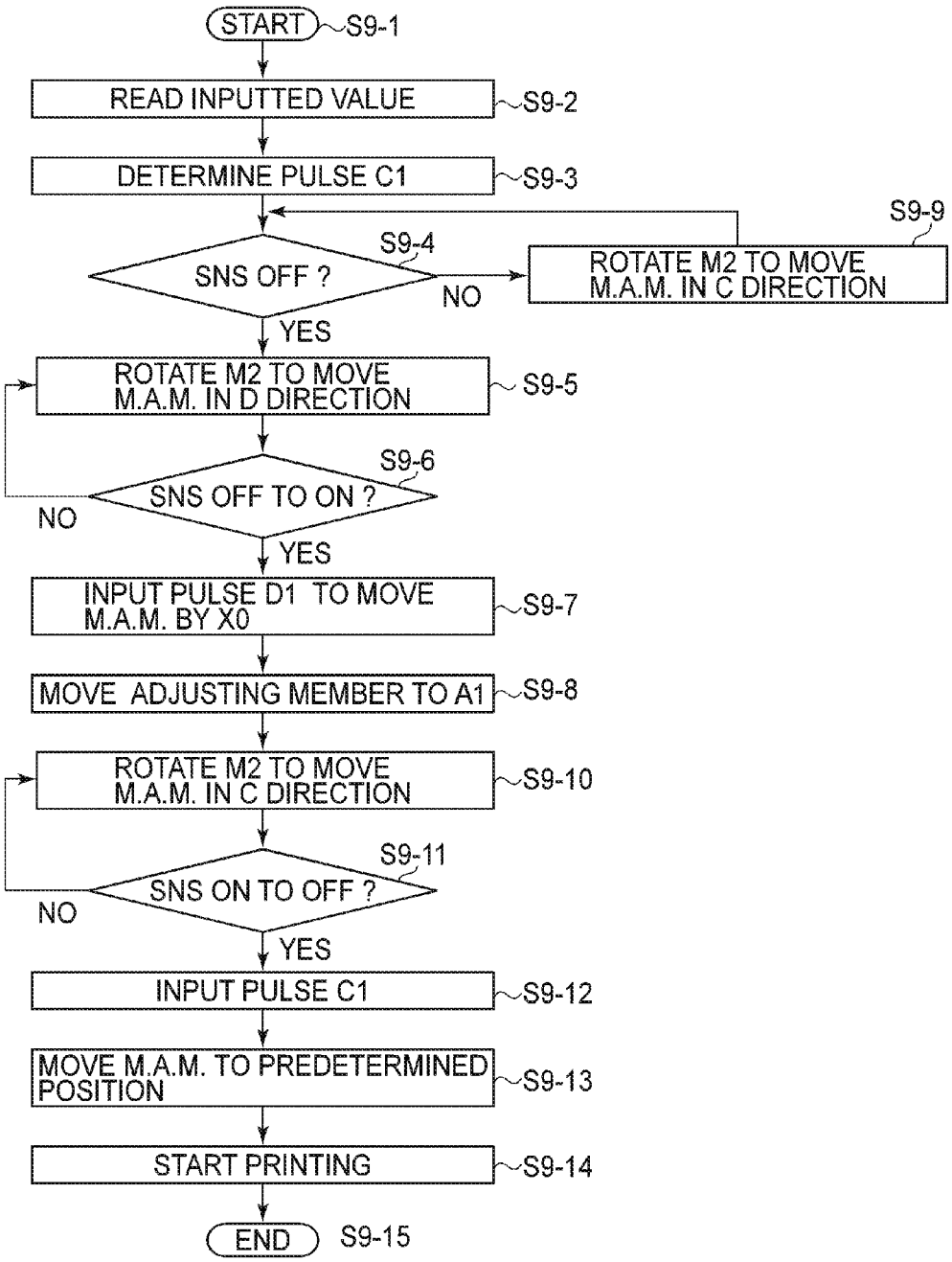
FIG. 9 is a flowchart of movement control of the magnetic flux suppressing member during sheet passing of a recording paper.

FIG. 9 is a flowchart of operation control of the magnetic flux suppressing members 52L and 52R in this embodiment. With reference to FIG. 9, an operation of the sensors 51 (51L and 51R) for holding the magnetic flux suppressing members 52 (52L and 52R) will be described by taking, as an example, the case where the size width of the recording paper P to be passed through the device A is the minimum size width W2.

When a print job is started (S9-1), the controller 100 reads an input value of the recording paper size from the recording paper size inputting means 104 (S9-2). Corresponding to the input value of the recording paper size, by computation of the controller 100, a pulse number C1 to be inputted into the driving motor M2 at the initial position A1 FIG. 1(*a*)) of the magnetic flux suppressing member 52 is determined (S9-3).

The controller 100 reads the signal of the sensor SNS (S9-4), and depending on an ON/OFF state of the sensor SNS, returns the magnetic flux suppressing member (magnetic flux adjusting means ("M.A.M.")) 52 to the initial position A1 shown in FIG. 1(*a*) by using the driving motor M2 and sensor SNS.

First, when the sensor SNS is in an OFF state, the magnetic flux suppressing member 52 is not located at the initial position A1 but is shifted toward a central side with respect to a direction perpendicular to the recording paper conveyance direction a, and therefore the magnetic flux suppressing member 52 is moved to the position shown in FIG. 1 (S9-5).

By reversely rotating and driving the driving motor M2, the magnetic flux suppressing member 52 is moved in an arrow D direction. Passing (sensor SNS signal changed from OFF to ON) of the flag 51*a*, provided on the slidable member 51, through a detection position of the sensor SNS is detected (S9-6). After the detection, a recording paper pulse D1 is inputted into the driving motor M2. As a result, at a position to which the magnetic flux suppressing member 52 is moved by X0, an operation of the magnetic flux suppressing member 52 is ended (S9-7), and the magnetic flux suppressing member 52 is moved to the initial position A1 (S9-8).

On the other hand, when the signal of the sensor SNS is an ON state, the driving motor M2 is normally rotated and driven so that the magnetic flux suppressing member 52 is moved in an arrow C direction (S9-9). Then, when switching (ON to OFF) of the signal of the sensor SNS is recognized (S9-4), the driving motor M2 is reversely rotated and driven, so that the magnetic flux suppressing member 52 is moved in the D direction (S9-5).

Thereafter, the flag portion 51*a* provided on the slidable member 51 passes through the detection position of the sensor SNS (i.e., the sensor SNS signal is changed from OFF to ON) (S9-6), and then the predetermined pulse D1 is inputted into the driving motor M2 (S9-7). As a result, at the position to which the magnetic flux suppressing member 52 is moved by X0, the operation of the magnetic flux suppressing member 52 is ended, and then the magnetic flux suppressing member 52 is moved to the initial position A1 (S9-8).

By rotating the driving motor M2, the magnetic flux suppressing member 52 is moved in an arrow C direction (S9-10). Passing (sensor SNS signal changed from ON to OFF) of the flag 51*a*, provided on the slidable member 51, through a detection position of the sensor SNS is detected (S9-11). After the detection, a recording paper pulse C1 is inputted into the driving motor M2 (M9-12). As a result, at a position to which the magnetic flux suppressing member 52 is moved by X1 shown in FIG. 1(*b*), an operation of the magnetic flux suppressing member 52 is ended (S9-13), and printing is started (S9-14). Thus, the control operation of the magnetic flux suppressing member is ended (S9-15). Further, when the print job is ended, the driving motor M2 is reversely rotated to move the magnetic flux suppressing member 52 in the arrow D direction, so that the magnetic flux suppressing member 52 is returned to the initial position A1 and thus the image forming apparatus is in a stand-by state for a print instruction (command).

As a result, corresponding to the minimum size width W2, it is possible to form a heat generation distribution capable of not generating the non-sheet-passing portion temperature rise.

Further, when the recording paper size is the maximum size width W1, the pulse C1 to be inputted into the driving motor M2 is zero, and then the printing is started without moving the magnetic flux suppressing member 52 from the initial position A1.

Further, with respect to recording paper having a longitudinal width W (W1>W>W2), to be passed through the fixing device A, the following operation is performed. That is, corresponding to the input value of the longitudinal width W of the recording paper, by computation of the controller 100, the recording paper pulse number C1 from the sensor SNS to be inputted into the driving motor M2 is changed. As a result, similar to the description provided above, it is possible to form the heat generation distribution, corresponding to the longitudinal width W of the recording paper, without inducing the non-sheet-passing portion temperature rise and the resulting improper fixing at the end portion of the recording paper.

The above-described control is summarized as follows. The controller 100 executes, during a heating job in which the recording paper is passed through and heated by the fixing device A, an operation in a moving mode during sheet passing in which the moving means (M2, 50 and 51) is controlled to move the magnetic flux suppressing members 52L and 52R to the adjusting positions A2 depending on information on the size width of the recording paper P to be passed through the fixing device A.

(8) Countermeasure Against Wax (8-1) Wax Contained in Toner

A toner T contains wax as a parting agent having a 60-90° C. melting point (temperature). Specifically, the toner T includes base material particles containing the wax having a melting point of 60° C. or more and 90° C. or less and a binder resin. The base material particles are formed so that an endothermic amount, resulting from the wax, of an endothermal peak in DSC measurement is 3.5 J/g or more and 5.5 J/g or less and an average circularity is 0.950 or more and 0.980 or less.

Thus, by incorporating the wax, having the welting point in the range of 60-90° C., into the toner T, not only a low temperature fixing property can be improved, but also a separating property (toner parting property) of the recording paper P from the belt 1 and the pressing roller 2 can be enhanced without applying oil onto the belt 1.

(8-2) Adhesion of Wax

In the case where the toner containing the wax is used, the wax volatilized at the position of the nip N or at the surface or the like of the belt 1 adheres to and is accumulated at the surfaces of the screw groove portions (screw shafts) 51L and 51R of the leading screw member 50 as the moving mechanism for the magnetic flux suppressing members 52L and 52R.

When the height of the accumulated wax exceeds an engaging spacing between an outer diameter portion of the screw portions 50L (50R) and the cylindrical portion 51*c* (51*d*) of the slidable member 51 (51L or 51R), an improper operation of the slidable member 51 is invited.

When the slidable member 51 for holding the magnetic flux suppressing member 52 causes the improper operation, it becomes difficult to move the magnetic flux suppressing member 52 correspondingly to the width size of the recording paper, so that there is a fear that the non-sheet-passing portion temperature rise is generated. Therefore, in this embodiment, the following countermeasure is taken.

(8-3) Cleaning Mode (Job)

Figure 10:
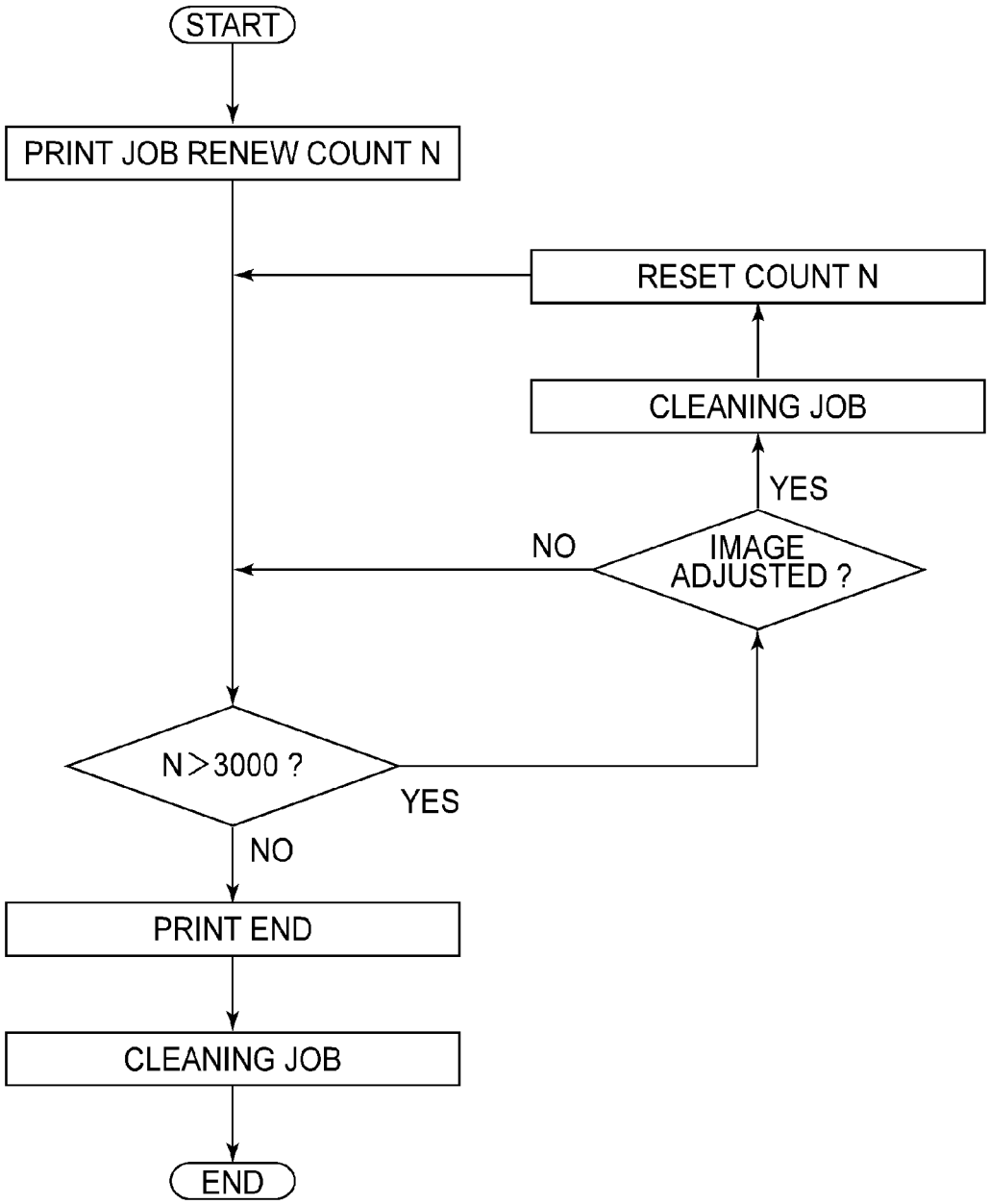
FIG. 10 is a flowchart of cleaning job control.

FIG. 10 is a flowchart of during an operation in the cleaning mode in this embodiment.

The operation in the cleaning mode is performed, in the case where the toner containing wax is used, for suppressing accumulation of the wax, volatilized at the position of the nip N or at the surface or the like of the belt 1, to the surfaces of the leading screw portions 50L and 50R. In the operation in the cleaning mode, the driving motor M2 is actuated to move the magnetic flux suppressing member 52 by at least one reciprocation in a region of a difference between the maximum size width W1 and the minimum size width W2 shown in FIG. 1(*b*).

Further, in the image forming apparatus, by the arrangement of the fixing device A shown below, the volatile matter of the wax generated in the neighborhood of the fixing device A is liable to adhere to the leading screw portions 50L and 50R. The reason therefor will be described with reference to FIG. 2.

In the image forming apparatus, in order to prevent heat conduction from the fixing device A to the image forming portions Y, C, M and K, at a boundary between the fixing device A and the image forming portions Y, C, M and K, an air flow portion F is provided. At the air flow portion F, the flow of the air is provided by an unshown fan, so that the heat conduction from the fixing device A to the image forming portions Y, C, M and K is suppressed. By this flow of the air, the volatile matter of the wax generated in the neighborhood of the fixing device A is stagnated with no escape route.

Further, in order to solve this problem, when the air stagnated in the neighborhood of the fixing device A is intended to be exchanged by air flow, quantities of heat of the fixing belt 1 and the pressing roller 2 are taken, so that there is a drawback that electric power consumption by the fixing device A becomes large.

For this reason, the volatile matter of the wax generated and stagnated in the neighborhood of the fixing device A is liable to adhere to the leading screw portions 50L and 50R. There is also a method of moving the leading screw member 50, the slidable member 51 and the like, which are movable portions, away from the neighborhood of the fixing device A, but there is the drawback that the image forming apparatus becomes large.

Against the above-described problems, in this embodiment, the operation in the cleaning mode for removing the wax adhered to the movable portions is performed. In the operation in the cleaning mode, the slidable members 51 (51L and 51R) for holding the magnetic flux suppressing members 52 (52L and 52R) are reciprocated in movement regions each ranging from (end of) the maximum size width W1 to (end of) the minimum size width W2. That is, the magnetic flux suppressing member 52 is caused to perform a forward operation from the initial position A1 to the adjusting position A2 and is caused to perform a backward operation from the adjusting position A2 to the initial position A1. As a result, it is possible to suppress the accumulation of the wax at slidable portions between the leading screw portions 50L and 50R and the slidable members 51 (51L and 51R), which are the movable portions.

As to the timing when the operation in the cleaning mode is performed, the operation is performed after the fixing or non-fixing, specifically during image adjustment of the image forming apparatus, performed depending on an integrated sheet passing number of the recording paper (the number of occurrences of the image heating) counted by a sheet number counter (part of the controller).

In FIG. 10, when the print job is started, the count N of an integrated print number is renewed. Depending on its count N of the sheets, the operation in the cleaning mode is performed. In this embodiment, a trigger for the sheet number count N for performing the operation in the cleaning mode was set at 3000 sheets. The reason why the trigger is set at 3000 sheets is as follows. In order not to impair productivity of the image forming apparatus, the timing of performing operation in the cleaning mode is a state in which the recording paper is not passed through the fixing device A. In this embodiment, the timing is interrelated with during the image adjustment, in the main assembly with respect to a minimum count sheet number of 3000 sheets, of the image adjustment.

First, in the case of a print job in which the sheet number count N does not exceed 3000 sheets, after the print job, the cleaning job is performed.

On the other hand, in the case where the sheet number count N exceeds 3000 sheets, at timing when the image forming apparatus main assembly starts the image adjustment (in a period in which a test pattern is formed for adjusting an image density or in the like period), the operation in the cleaning job is performed in parallel. After the execution of the operation in the cleaning mode, the sheet number count N is reset to zero, and then the print job is performed again.

By employing the above-described constitution, the operation in the cleaning mode for cleaning the wax adhered to the leading screw portions 50L and 50R and the slidable members 51 (51L and 51R) which are the movable portions for the magnetic flux suppressing members 52 (52L and 52R) is performed. As a result, the adhered wax can be removed, so that the improper operation at the movable portions for the magnetic flux suppressing members 52 can be prevented. As a result, it is possible to form a heat generation distribution, corresponding to respective recording paper sizes, without inducing the non-sheet-passing portion temperature rise and the end-portion improper fixing.

The above-described control is summarized as follows. The controller 100 executes, in order to remove the wax adhered to the leading screw portions 50L and 50R and the slidable members 51 (51L and 51R) which are the movable portions for the magnetic flux suppressing members 52 (52L and 52R), a movement mode during non-sheet passing, as described below, during the non-sheet passing of the recording paper. That is, the controller 100 controls the moving means (M2, 50 and 51) to execute an operation in a control mode in which each of the magnetic flux suppressing members 52L and 52R is moved between the initial position A1 and the adjusting position A2 where the magnetic flux acting in the non-sheet-passing portion region is decreased when the predetermined size of recording paper, having the minimum size width W2, is passed through the fixing device.

The controller 100 performs, after a heating job for heating the recording paper by sheet passing, as an operation in the movement mode during non-sheet passing, a reciprocal movement operation at least once (one reciprocal movement) between the initial position A1 of each of the magnetic flux suppressing member 52L and 52R and the adjusting position A2 corresponding to the recording paper having the minimum size width W2.

The controller 100 executes, during the image adjustment at the image forming portions for forming the images on the recording paper to be passed through the fixing device, the operation in the movement mode during non-sheet passing. That is, the controller performs the reciprocal movement operation corresponding to at least one reciprocation between the initial position A1 of each of the magnetic flux suppressing members 52L and 52R and the adjusting position A2 corresponding to the recording paper having the minimum size width W2.

(8-4) Operation Speed of Cleaning Job

When the fixing device is continuously used, by the adhered wax, there is a tendency that a sliding resistance between the leading screw portion 50L or 50R and the slidable member 51 (51L or 51R) becomes large. As a countermeasure thereof, the operation speed of the driving motor M2 for driving the leading screw portion 50 may also be selectively used between during the normal mode (during the fixing) shown in FIG. 9 and during the cleaning mode shown in FIG. 10.

In this embodiment during the operation in the cleaning mode, in order to ensure an output torque of the driving motor M2 capable of withstanding a sliding load between the leading screw portion 50L (50R) and the slidable member 51L (51R), the operation speed of the driving motor M2 is made lower than the operation speed during the normal mode (during the fixing).

Further, in this embodiment, a time t2 required for one reciprocation during the operation in the normal mode was 8 seconds, and a time t1 required for one reciprocation during the cleaning job was 18 seconds. The reason why the time t1 is 18 seconds is that a time t3 required for the image adjustment interrelated with the cleaning job is 20 seconds. Therefore, t2<t2<T3 is satisfied, so that a stepping motor is used as the driving motor M2 in order not to impair productivity in a period other than the image adjustment period, and is used by switching the operation speed between during the normal mode and during the cleaning mode.

The above-described control is summarized as follows. The movement time required for reciprocating the magnetic flux suppressing members 52L and 52R between the initial position A1 and the adjusting position, corresponding to the recording paper having the minimum size width W2, in the operation in the normal mode performed during the fixing is t1. The movement time required for reciprocating the magnetic flux suppressing members 52L and 52R between the initial position A1 and the adjusting position, corresponding to the recording paper having the minimum size width W2, in the operation in the coil mode performed during the non-fixing is t2. The time required for performing the image adjustment at the image forming portion is t3. The relationship: t2<t2<t3 is satisfied.

1) In the operation in the coil mode, it is also possible to employ a constitution in which the magnetic flux suppressing member is reciprocated in a range wider than the normal movement range between the initial position A1 and the adjusting position (predetermined position or magnetic flux suppressing position) corresponding to the minimum size width W2.

2) Alternatively, in the operation in the coil mode, it is also possible to employ a constitution in which the magnetic flux suppressing member is reciprocated between an end portion and another end portion, with respected to the widthwise direction, of a movable region in which the magnetic flux suppressing member is movable.

Such a constitution is effective in the case where a further premium is placed on a cleaning property by the operation in the coil mode in the constitution in which the movable region in which the magnetic flux suppressing member is movable is broad.

Embodiment 2

Figure 11:
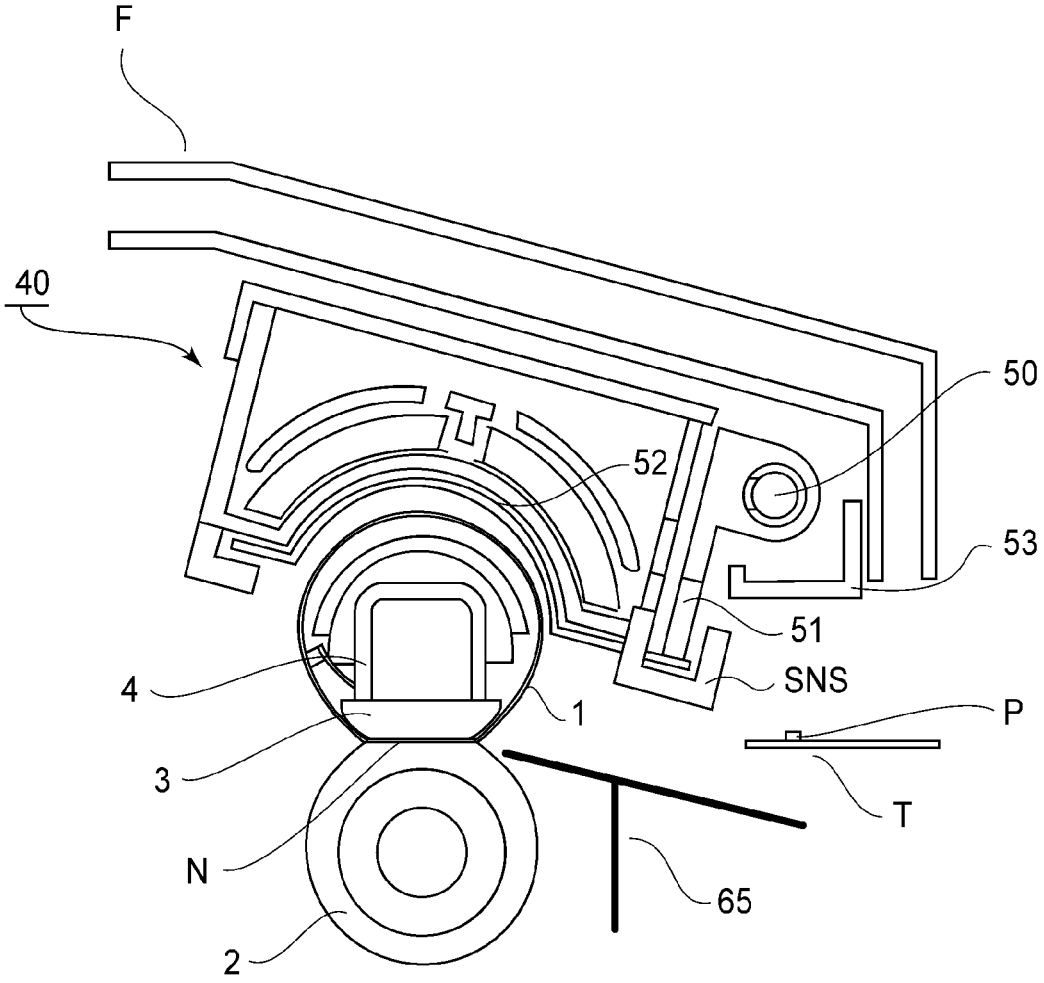
FIG. 11 is an enlarged schematic cross-sectional view of a principal part of a fixing device in Embodiment 2.

FIG. 11 is a schematic cross-sectional view of a principal portion of a fixing device A in this embodiment. The fixing device A in this embodiment is only different from the fixing device A in Embodiment 1 in that a protective member 52 for suppressing adhesion of the wax to the leading screw portions 50L and 50R is added, and therefore constitutions and operations of common portions will be omitted from description.

In the fixing device A in this embodiment, in order to suppress the adhesion of the wax, volatilized from the fixing nip N, to the leading screw portions 50L and 50R, the protective member 53 provided for covering the movable portion of the moving means is disposed. The protective member 53 has a function of suppressing the entrance of the wax into the leading screw portions 50L and 50R and of causing the wax to adhere the protective member 53. The protective member 53 is constituted by a material (e.g., metal such as aluminum or copper) having high thermal conductivity, and its metal surface is exposed toward the leading screw portions 50L and 50R, so that the volatile matter of the wax generated in the neighborhood of the fixing device A is condensed to accelerate the adhesion of the wax to the protective member 53.

On the other hand, in the sheet passing side of the recording paper opposing the protective member 53, in order to prevent the wax adhered to the protective member 53 from adhering to the recording paper to generate image defect, a non-woven fabric (formed of, e.g., polyester resin) is applied so that the wax is not readily adhered to the recording paper.

That is, the protective member 53 is constituted by a metal surface in an inner surface side opposing the moving means 50 and 51 and by the non-woven fabric in an outer surface side opposite from the inner surface side.

Further, the protective member 53 has a recessed shape in the side opposing the leading screw portions 50L and 50R. As a result, the wax removed from the surfaces of the leading screw portions 50L and 50R by the execution of the cleaning job (FIG. 10) described in Embodiment 1 is prevented from dropping into the entrance guide 65 to adhere to the recording paper P, thus preventing the generation of the image defect.

By employing the above-described constitution, the adhered wax is removed by performing the job for removing the wax adhered to the leading screw portions 50L and 50R and the slidable members 51 (51L and 51A) which are the movable portions for the magnetic flux suppressing members 52 (52L and 52R). As a result, it is possible to prevent an improper operation of the magnetic flux suppressing members 52 at the movable portions. Accordingly, it is possible to form the heat generation distribution, corresponding to the paper size of each of the recording papers, without inducing the non-sheet-passing portion temperature rise and the end portion improper fixing.

Other Embodiments

1) The belt member as the rotatable heating member 1 can also be formed in an endless belt member, having flexibility, which is extended and stretched around a plurality of stretching members and which is circulated and moved by the driving roller. The rotatable heating member 1 can also be formed in a roller member.

2) It is also possible to employ a device constitution of an internal heating type in which the coil unit 40 is provided inside the rotatable heating member 1.

3) The back-up member 2 for forming the nip N with the rotatable heating member 1 is not limited to a roller member. It is also possible to employ a rotatable endless belt member. Further, it is also possible to use the back-up member 2 in the form of a non-rotatable member (pressing pad or the like) having a small friction coefficient at a surface (contact surface with the rotatable heating member 1 or the recording paper P). It is also possible to employ a constitution in which also the back-up member 2 is heated.

4) The sheet passing (conveyance) of the recording paper P through the device A is not limited to be effected on the center (line) basis. It is also possible to employ a device constitution in which one-side basis in which the sheet passing (conveyance) is made on the basis of one-side edge portion of the recording paper with respect to the widthwise direction. In this constitution, the magnetic flux suppressing member is not provided in pair but is provided as a single member.

5) The use of the image heating apparatus is not limited to the use as the fixing device for fixing, as a fixed image, the unfixed toner image formed on the recording paper as in the above-described embodiments. The image heating apparatus of the present invention is also effective as an apparatus (device), for adjusting a surface property of an image, such that the glossiness of the image is improved by heating and pressing again the toner image (fixed toner image or temporarily fixed toner image) which is once fixed or temporarily fixed on the recording paper.

6) The type of the image forming portions of the image forming apparatus is not limited to the electrophotographic type. The image forming portions may also be of an electrostatic recording type or a magnetic recording type. Further, the type of the image forming portions may also employ a constitution in which the unfixed toner image is directly transferred from the photosensitive member onto the recording paper without using the intermediary transfer member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 169518/2012 filed Jul. 31, 2012 which is hereby incorporated by reference.

What is claimed is:

1. An image heating apparatus comprising:

a rotatable heating member configured to heat a toner image formed on a sheet by using a toner containing a wax;

an exciting coil configured to cause said heating member to generate heat by electromagnetic induction heating;

a magnetic flux suppressing member configured to suppress a part of magnetic flux actable from said exciting coil onto said heating member;

a rotatable screw shaft configured to hold said magnetic flux suppressing member and configured to slide said magnetic flux suppressing member along a longitudinal direction of said heating member; and a controller configured to control a rotational movement operation of said screw shaft so that said magnetic flux suppressing member is placed in a position depending on a width size of the sheet, wherein said controller is, during non-image heating, configured to execute an operation in a mode in which said screw shaft is rotationally moved so that said magnetic flux suppressing member is reciprocated at least once in a predetermined range.

2. An image heating apparatus according to claim 1, wherein when a predetermined sheet, having a minimum width size, usable in said image heating apparatus is subjected to image heating, said controller rotationally moves said magnetic flux suppressing member so as to be moved from an initial position to a predetermined position corresponding to the minimum size width of the predetermined sheet, and wherein when the operation in the mode is executed, said controller rotationally moves said magnetic flux suppressing member so as to be reciprocated between the initial position and the predetermined position.

3. An image heating apparatus according to claim 2, further comprising a motor configured to rotationally drive said screw shaft, wherein said controller causes the operation speed of said motor when the operation in the mode to be executed slower than the operation speed of said motor when the predetermined sheet is subjected to the image heating.

4. An image heating apparatus according to claim 2, wherein when a maximum width sheet usable in said image heating apparatus is subjected to the image heating, said controller locates said magnetic flux suppressing member at the initial position.

5. An image heating apparatus according to claim 2, wherein said magnetic flux suppressing member is configured to be positioned at the initial position and the predetermined position while said magnetic flux suppressing member is reciprocated in the mode.

6. An image heating apparatus according to claim 1, further comprising a counter configured to count the number of occurrences of image heating, wherein said controller executes the operation in the mode depending on an output of said counter.

7. An image heating apparatus according to claim 1, further comprising a holder configured to hold said magnetic flux suppressing member and configured to be engaged with said screw shaft.

8. An image heating apparatus according to claim 1, wherein said exciting coil is provided outside said heating member, and wherein said magnetic flux suppressing member is movable between said exciting coil and said heating member.

9. An image heating apparatus according to claim 1, further comprising another magnetic flux suppressing member configured to suppress a part of magnetic flux actable from said exciting coil onto said heating member, and another rotatable screw shaft configured to hold said another magnetic flux suppressing member and configured to slide said another magnetic flux suppressing member along the longitudinal direction of said heating member, wherein said screw shaft and said another screw shaft are coaxially provided, and spiral directions of said screw shaft and said another screw shaft are opposed to each other.

10. An image heating apparatus according to claim 9, wherein said screw shaft and said another screw shaft are integrally molded.

11. An image heating apparatus comprising:

a rotatable heating member configured to heat a toner image formed on a sheet by using a toner containing a wax;

an exciting coil configured to cause said heating member to generate heat by electromagnetic induction heating;

a magnetic flux suppressing member configured to suppress a part of magnetic flux actable from said exciting coil onto said heating member;

a rotatable screw shaft configured to hold said magnetic flux suppressing member and configured to slide said magnetic flux suppressing member along a longitudinal direction of said heating member; and a controller configured to control a rotational movement operation of said screw shaft so that said magnetic flux suppressing member is placed in a position depending on a width size of the sheet, wherein said controller is, during non-image heating, configured to execute an operation in a mode in which said screw shaft is rotationally moved so that said magnetic flux suppressing member is reciprocated at least once in a movable range of said magnetic flux suppressing member during image heating.

12. An image heating apparatus according to claim 11, wherein said magnetic flux suppressing member is, during the image heating, movable from an initial position to a magnetic flux suppressing position when a predetermined sheet, having a minimum width size, usable in said image heating apparatus, is subjected to the image heating, and wherein the movable range is a range between the initial position and the magnetic flux suppressing position.

13. An image heating apparatus according to claim 12, further comprising a motor configured to rotationally drive said screw shaft, wherein said controller causes the operation speed of said motor when the operation in the mode is executed to be slower than the operation speed of said motor when the predetermined sheet is subjected to the image heating.

14. An image heating apparatus according to claim 12, wherein when a maximum width sheet usable in said image heating apparatus is subjected to the image heating, said controller locates said magnetic flux suppressing member at the initial position.

15. An image heating apparatus according to claim 12, wherein said magnetic flux suppressing member is configured to be positioned at the initial position and the magnetic flux suppressing position while said magnetic flux suppressing member is reciprocated in the mode.

16. An image heating apparatus according to claim 11, further comprising a counter configured to count the number of occurrences of image heating, wherein said controller executes the operation in the mode depending on an output of said counter.

17. An image heating apparatus according to claim 11, further comprising a holder configured to hold said magnetic flux suppressing member and configured to be engaged with said screw shaft.

18. An image heating apparatus according to claim 11, wherein said exciting coil is provided outside said heating member, and wherein said magnetic flux suppressing member is movable between said exciting coil and said rotatable heating member.

19. An image heating apparatus according to claim 11, further comprising another magnetic flux suppressing member configured to suppress a part of magnetic flux actable from said exciting coil onto said heating member, and another rotatable screw shaft configured to hold said another magnetic flux suppressing member and configured to slide said another magnetic flux suppressing member along the longitudinal direction of said heating member, wherein said screw shaft and said another screw shaft are coaxially provided, and a spiral directions of said screw shaft and said another screw shaft are opposed to each other.

20. An image heating apparatus according to claim 19, wherein said screw shaft and said another screw shaft are integrally molded.

* * * * *